US005741447A

United States Patent [19]

Bond

[11] Patent Number: 5,741,447

[45] Date of Patent: Apr. 21, 1998

[54] METHOD OF PRINTING ONTO PRESSURE-SENSITIVE RECORD MATERIALS

[75] Inventor: Michael Peter Bond, Barnrooden, United Kingdom

[73] Assignee: Carrs Paper Limited, West Midlands, United Kingdom

[21] Appl. No.: 433,374

[22] PCT Filed: Sep. 5, 1994

[86] PCT No.: PCT/GB94/01922

§ 371 Date: May 4, 1995

§ 102(e) Date: May 4, 1995

[87] PCT Pub. No.: WO95/07188

PCT Pub. Date: Mar. 16, 1995

[30] Foreign Application Priority Data

Sep. 4, 1993 [GB] United Kingdom ..... 9318369

[51] Int. Cl.[6] ..... B41M 5/00

[52] U.S. Cl. ..... 264/4; 101/288; 101/491

[58] Field of Search ..... 264/4, 4.1; 101/288, 101/491

[56] References Cited

U.S. PATENT DOCUMENTS 4,783,196 11/1988 Eckstein et al. ..... 8/527

4,859,650 8/1989 Hilterhaus et al. ..... 503/213

4,996,240 2/1991 Osipow et al. ..... 521/78

5,464,803 11/1995 McGuinness et al. ..... 503/213

OTHER PUBLICATIONS

Derwent Abstract #74–31778v abstracting JP 49–013456 (1974).

Sanders et al. "Carbonless Paper for Xerographic Duplicator/Printers" Proceedings The 6th International Congress on Advances in Non–Impact Printing Technologies pp. 739–745, Oct. 1990.

*Primary Examiner*—Jeffrey Mullis

*Attorney, Agent, or Firm*—Plevy & Associates

[57] ABSTRACT

Disclosed is a method for printing onto pressure-sensitive record material of the kind comprising a base sheet, typically of paper, coated with a ruptutrable material confining droplets of color forming substances in a solutuion of animal or vegetable oil solvent, which when released by rupture of the material undergo a color forming reaction to produce an image either on the base sheet itself or on a further receptor sheet in face-to-face contact with the coated face of the base sheet.

8 Claims, No Drawings

METHOD OF PRINTING ONTO PRESSURE-SENSITIVE RECORD MATERIALS

DESCRIPTION OF INVENTION

This invention relates to a method of printing onto pressure-sensitive record materials of the kind comprising a base sheet, typically of paper, coated with a rupturable material confining droplets of a solution of colour-forming substances, which when released by rupture of the material undergo a colour-forming reaction to produce an image either on the base sheet itself or on a further, receptor sheet in face-to-face contact with the coated face of the base sheet.

In particular, but without limitation, the invention is applicable to so-called "carbon-less" copy papers which rely on two coatings formed respectively on the contiguous faces of superimposed sheets of paper, namely a coating containing the colour-forming substance in the micro-capsules, on the back of the uppermost sheet (usually known as a CB coating) and a coating of a receptor layer on the front of the lowermost sheet (usually known as a CF coating). Colour-forming chemicals are typically dissolved in an oily solvent and encapsulated by well known techniques, and when such capsules are ruptured by mechanical pressure, as by impact of a type bar of a typewriter, the chemicals are released and react to form a visible mark on the CF coating of the adjacent sheet.

Conveniently, paper for use in such copying systems is of three types, distinguished by their coatings, namely CB sheets having a CB coating on the underside to form the top sheet of the set, CF sheets having a CF coating on the upper side to form the bottom sheet of a set, and optionally CFB sheets having a CF coating on the upper side and a CB coating on the underside to form one or more intermediate sheets of a set where required. Such coatings are normally applied by a continuous process to cover the entire area of the appropriate face of the sheet.

In recent years, there has been a demand for printing onto such coated paper as the recipient material in toner-based printing systems in which an image is transferred to the recipient material electrostatically, a process sometimes known as "xerographic, electronic or laser printing". However, difficulties have been experienced in such electrostatic printing systems when the recipient material comprises such coated papers. In particular, it appears that the handling of CB and CFB material, either before or during the printing process, may rupture some of the capsules containing the colour-forming chemicals, and this is particularly liable to lead to "poisoning" of the electrostatic transfer drum or loop and also contamination of paper-feed, fuser and pressure rollers so that the printing apparatus fails to perform satisfactorily after a short period of operation using such CB (or CFB) sheets.

Conventional colour-formers, e.g. various leuco-dye stuffs, have normally been dissolved in a range of organic solvents, typically aromatic solvents, which afford adequate solubility for conventional colour-formers and enable a good image to be produced. However, such conventional solvents appear to be mainly responsible for the above-mentioned problems with any printing apparatus, which incorporates components made of rubber (natural or synthetic) elastomers and/or polymers (i.e. such materials as nitriles, urethanes, EPDM, and particularly thermally conductive polydinethylfiloxane materials as used for fuser rolls), especially When operating above ambient temperatures. In addition synthetic and other capsules are brittle and are more readily fractured. This can lead to a build-up of micro-capsule dust which will damage mechanical parts of such electronic printing systems.

Proposals have been made with regard to the use of alternative encapsulation systems but so far no wholly acceptable alternative system has been found. It has been suggested that the micro-capsule is treated in such a way as to decrease the risk of premature rupture of the micro-capsules, but this results in a decrease in the imaging sensitivity of the material in subsequent use. Moreover, such specially treated coatings are inherently unsafe since in practice paper crashes or other transfer or printing problems may still cause significant contamination of the printing apparatus.

Much thought has been given to these problems, as summarised particularly in the Proceedings of the Sixth International Congress on Advances in Non-Impact Printing Technologies, in October 1990. This paper recognises the above problems and indeed identifies the solvent oils as an obvious candidate for the source of these problems. However, the potential remedies which are proposed are mainly "mechanical" in nature, such as the use of thicker-walled micro-capsules, capsule size control techniques and machine modifications, rather than looking to alternative solvents as a potential solution to the problems.

This problem has been addressed in a somewhat similar manner by our British Patent No. 2218124 whereby generally conventional carbon-less copy paper is folded or otherwise arranged to bring the CB coated faces of two contiguous sheets into face-to-face relation before printing onto the other, exposed, faces of the two sheets. This effectively eliminates contamination of the printing apparatus, but has the attendant disadvantage that ancillary equipment is needed to separate the two sheets after printing.

Many different systems of colour-formers and solvents have been proposed, including some which employ, at least in part, animal or vegetable oils as solvents. European Patent specification 0520639 A1 published 30th Dec. 1992 contains a lucid summary of such proposals which are directed to various improvements in the performance of the copy paper in various respects, but generally where the use of animal or vegetable oils as solvents is proposed either it is found necessary to use a synthetic oil as a co-solvent, or systems using animal or vegetable oils as solvents have been evaluated only as control examples to verify the superior performance of other solvent/colour-former systems, for example as in European Patent specification 0520639 itself.

Surprisingly, we have found that the use of animal or vegetable oils as solvents for the colour-formers not only overcomes the problems associated with contamination of the synthetic materials employed in toner-based printing machines, but can provide a commercially viable copy system contrary to the suggestions of the prior art, and in accordance with the invention we provide a method of printing by means of a toner-based (e.g. xerographic, electronic or laser) systems onto pressure-sensitive record material of the kind comprising a base sheet having thereon a coating comprising a rupturable material confining droplets of a solution of colour-formers, characterised by the use of such a pressure-sensitive record material in which the colour-formers are dissolved in a solvent comprising only one or more animal and/or vegetable oils.

We have found that animal or vegetable oils are non-deleterious if allowed to come into contact with rubber, elastomeric and/or polymeric materials of the kind conventionally employed for the manufacture of conveying systems and other components of printer operating on toner-based systems, unlike the solvents conventionally employed for colour-formers, such as alkylated naphthalene, chlorinated paraffins and hydrogenated terphenyls or other hydrocarbons.

The colour-former solution droplets may be confined in a rupturable continuous phase medium or in individual micro-capsules formed from said rupturable material, and preferably such micro-capsules are formed from a gelatine-based or other similar soft material.

The use of gelatine-based or other similar soft-walled capsules minimises the production of loose debris other, vise formed by fracture of the micro-capsules during handling of the copy paper.

The colour-formers used preferably comprise at least 90% of colour-formers which incorporate lactone rings or fluoran groups and are monoamino and/or diamino fluoran derivatives, and/or phthalide derivatives and/or pyridyl derivatives, and such colour-formers are preferably dissolved in said oils at a temperature in excess of that normally employed, for example in the range 100° C. to 135° C.

Apart from the preparation and composition of the internal phase or core material, the layer of continuous phase material or micro-capsules used for the pressure-sensitive copying paper used in the inventive method are prepared by conventional methods and as such do not require an in depth description.

Using as internal phase the solution of chromogenic materials dissolved in animal and/or vegetable oil, micro-capsules can be prepared by the coacervation of gelatine and one or more other polymers such as carboxymethyl cellulose in conventional manner.

The micro-capsules produced may be blended with a binder, such as starch or polyvinyl alcohol or a mixture of both, and undissolved buffer or "stilt" material such as calibrated wheat starch or finely ground cellulose floc (or a mixture of both) to prevent premature rupture of the coating composition during processing and subsequent handling.

The above coating composition may be applied to a range of paper substrates (40 gsm–150 gsm) by use of standard coating techniques designed to apply a closely monitored wet film weight e.g. air knife, offset gravure, metering roll.

In order to effect total dissolution of the chromogenic materials at the required concentration it is necessary to raise the temperature of the animal and/or vegetable oils to temperatures well above those required for conventional internal phase solvents such as alkylated naphthalene, chlorinated paraffins and hydrogenated terphenyls.

Experiment has shown that in order to affect total dissolution of the chromogenic materials it is necessary to raise the temperature of the oil to 100° C.–135° C. as compared with the temperatures required for conventional internal phase solvents which are generally below 100° C.

The invention is illustrated by the following non-limiting specific examples. All formulations are expressed by weight unless otherwise stated, and the specific colour formers employed in these examples are as follows:

A) 3,3-Bis(4(dimethylamino)phenyl)-6-dimethylamino phthalide

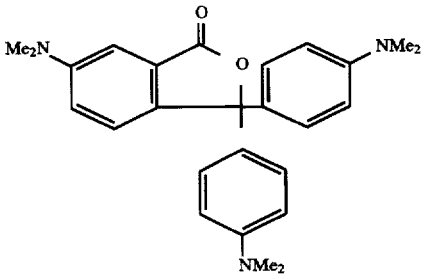

(A)

B) 2'-(Octylamino)-6'-(diethylamino)fluoran:

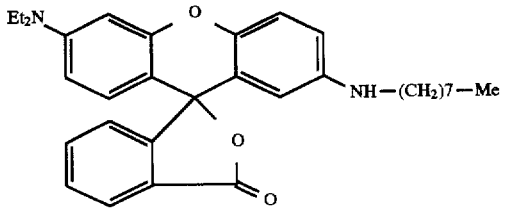

(B)

C) 2'-Anilino-3'-methyl-6'(diethylamino)fluoran

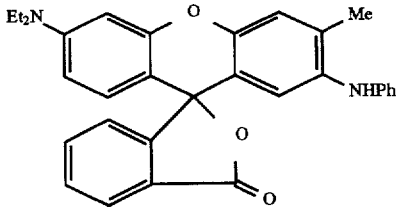

(C)

D) 6'-(diethylamino)-2'-(1,1-dimethylethyl)-spiro[isobenzofuran-1(3H),9'-[9H]xanthen]-3-one, -continued

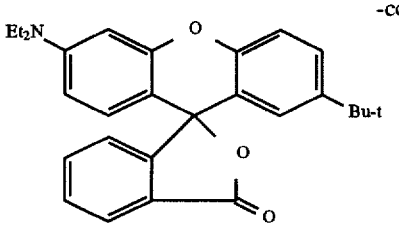

(D)

E) 6'-(dibutylamino)-3'-methyl-2'-(phenylamino)- Spiro[isobenzofuran-1(3H),9'-[9H]xanthen]-3-one,

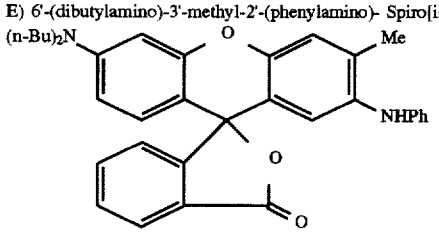

(E)

where

Me=methyl ($CH_3$—)

Et=ethyl ($CH_3$—$CH_2$—)

Bu-t=tert-butyl ($(CH_3)_2$—CH—$CH_2$—)

Ph=phenyl ($C_6H_6$—)

The above-identified colour-formers were used in the following combinations as set out in Table 1.

TABLE I

| COLOUR FORMER | EXAMPLE 1 | EXAMPLE 2 | EXAMPLE 3 |
|---|---|---|---|
| A | 41.1 | — | — |
| B | 31.5 | 65.0 | 65.0 |
| C | 21.1 | 20.0 | 20.0 |
| D | 6.3 | 15.0 | 7.5 |
| E | — | — | 7.5 |
| | 100 | 100 | 100 |

EXAMPLE 1

(i) Preparation of Internal Phase Solution

The four selected chromogenic materials used in this example (A,B,C,D) were mixed in the proportions indicated in Table I such that an intense black print is subsequently obtained in use.

The mixture of chromogenic materials was dispersed into deodorised refined rape seed oil and the temperature raised to 125°–130° C.

In order to ensure total dissolution the temperature was held for 30 minutes. The concentration of the chromogenic materials dispersed in rape seed oil was 6.9%.

The above solution was then allowed to cool at 60° C. and maintained at this temperature.

(ii) Preparation of Emulsion

The internal phase solution was emulsified in a mixture of gelatine and carboxymethyl cellulose (CMC) at 55°±5° C. to a mean capsule size of approximately 5 micron as measured using a Coulter Counter.

(iii) Coacervation Process

The emulsion (ii above) was diluted by the addition of soft water and the pH adjusted by the addition of 20% Sodium Hydroxide to a pH value 9.0–9.5.

Dilute acetic acid was added to reduce the pH of the gelatine below the isoelectric point resulting in a change in charge of the gelatine and, on further acidification, the formation of liquid coacervates results from the phase separation and inter-relation with the negatively charged C.M.C. in conventional manner.

On further acidification the liquid coacervates are attracted to the nucleus or core material (i.e. the internal phase solution produced at (i) above) and coalesce to form a liquid wall.

When further acidification resulted in the desired degree of clustering acidification was stopped.

(iv) Cooling

The dispersion was cooled at 8° C.–10° C. in order to gel the liquid walls of the coacervates.

At 8° C–10° C. the liquid walls were cross linked by the addition of an aldehyde (e.g. formaldehyde) and followed by an increase in pH by the further addition of 20% sodium hydroxide to pH 9.0.

(v) Ageing/Finishing

The cross linked dispersion was returned to ambient temperature and allowed to homogenise and condition (e.g. age) for a predetermined period (1–3 hours).

After ageing the resultant capsule dispersion was blended with a suitable binder (e.g. starch or starch/P.V.A. mixture) and a suitable "stilt buffer" (e.g. cellulose floc or calibrated wheat starch) to produce a mixture suitable for coating onto a sheet material by conventional means.

The pressure-sensitive record material thus produced has been found to have a good shelf life and to provide intense colour-forming.

EXAMPLE 2

The three selected chromogenic materials (B,C,D) were mixed in the proportions indicated in Table 1 such that an intense black print is subsequently obtained in use. In this example these three chromogenic materials were initially dispersed in a solvent comprising deodorised refined rape-seed oil at a concentration of 6.9% at ambient temperature and the temperature was increased to 110°–115° C. for 30 minutes.

The subsequent preparation of the emulsion, the co-acervation process, cooling and ageing/finishing proceeded as in Example 1.

EXAMPLE 3

The four chromogenic materials (B,C,D,E) were mixed in the proportions indicated in Table I such as to achieve an intense black print and dispersed into deodorised refined rape-seed oil at 110°–115° C. for 30 minutes at a concentration of 6.9%. Thereafter the procedure was in accordance with Example 1.

Such colour-former solutions have been prepared and encapsulated on a full commercial scale.

The pressure-sensitive record material thus produced in each of the above Examples has been found to have a good shelf life and to provide intense colour-forming, and it has been extensively used in conventional printing apparatus of the kind utilizing a toner-based printing system without giving rise to any significant problems of contamination.

Laboratory scale encapsulations have also been made and tested with similar good results, utilising other vegetable oils such as sunflower oil and animal oils such as cod liver oil and beef dripping, and various mixtures of such oils.

To further evaluate the usefulness of animal and vegetable oils as solvents which are innocuous to the elastomers of the kind employed in toner-based printing apparatus, a series of tests has been carried out to determine the effect of such oils on such elastomers. These tests involve the immersion of pieces of elastomer obtained from the fuser roll of a commercially available toner-based printing machine in a range of solutions, each containing the same colour-former formulation dissolved in a different oil. The vegetable oil and animal oils were heated to 140° centigrade to ensure complete solution of the colour-formers, whereas the two minerals oils used for comparison purposes were heated only to 110° centigrade to achieve complete solution of the colour-formers.

A section of elastomer was removed from the fuser roll for each test and the dimensions measured to determine its thickness and volume. Each section was then immersed for a period of 24 hours in the respective solution and then re-measured. These tests were carried out at 20° centigrade and at 100° centigrade and the results are shown respectively in Tables II and III.

TABLE II

Elastomer solvent immersion tests 24 hours 20° centigrade.

| Sample | Solvent | Change in Thickness(%) | Change in Volume(%) |
|---|---|---|---|
| (a) | Cod liver oil | −0.388 | +0.555 |
| (b) | Olive oil | 0.000 | 0.000 |
| (c). | Ground nut oil | −0.547 | +0.916 |
| (d). | Grape seed oil | +0.039 | −1.027 |
| (e). | Corn oil | −0.197 | −0.197 |
| (f). | Rape seed oil | −0.196 | +1.068 |
| (g). | Sun flower oil | −0.040 | +2.990 |
| (h). | Beef dripping | −0.312 | −0.312 |
| X. | *alkylated naphthalene/ aliphatic hydrocarbon | +10.53 | +29.54 |
| Y. | *chloroparaffin/ aliphatic hydrocarbon | +7.21 | +19.40 |

*1:1(v/v)mixture

TABLE III

Elastomer solvent immersion tests 24 hours 100° centigrade

| Sample | Solvent | Change in thickness(%) | Change in volume(%) |
|---|---|---|---|
| (a) | Cod liver oil | +0.237 | +1.854 |
| (b) | Olive oil | +0.278 | +0.278 |
| (c). | Ground nut oil | +0.195 | +1.297 |
| (d). | Grape seed oil | +0.273 | −2.234 |
| (e). | Corn oil | +0.039 | −1.500 |
| (f). | Rape seed oil | +0.234 | +0.234 |
| (g). | Sun flower oil | −0.080 | −0.080 |
| (h). | Beef dripping | −0.316 | −0.316 |
| X. | *alkylated naphthalene/ aliphatic hydrocarbon | +14.19 | +41.13 |
| Y. | *chloroparaffin/ aliphatic hydrocarbon | +10.05 | +34.84 |

*1:1(v/v)mixture

For the most part the measurements on Samples (a) to (h) can be regarded as showing no change in thickness or volume within the limits of experimental error, or only very minor swelling when compared with Samples (X) and (Y) where the swelling is very marked even at room temperature.

The colour-formers dissolved satisfactorily in all such solvents and the previously described laboratory scale tests suggest that all the animal and vegetable oil solvents of Samples (a) to (h) would be viable.

Whilst in the above-described examples 2 and 3 the colour-formers used are all fluoran derivatives, and are preferred to Example 1 which includes a large portion of Crystal Violet Lactone (CVL), it is to be understood that additional non-fluoran colour-formers may be included at up to 10% of the colour-former formulations.

I claim:

1. A method of preventing or reducing contamination of and damage to components of a toner-based printing apparatus made of natural or synthetic rubber, elastomers, and/or polymers when printing onto pressure-sensitive record material including a base sheet having a coating of a rupturable material confining droplets of a solution of colour-formers, the method comprising:

dissolving said colour-formers in a solvent of at least one of the group consisting of animal oils and vegetable oils, to produce said coating of a rupturable material confining droplets of a solution of colour-formers; and using said base sheet having a coating in said toner-based printing apparatus in printing operations to reduce contamination of and damage to said components, wherein leakage of said droplets onto components does not deleteriously affect said natural or synthetic rubber, elastomer, and/or polymer components.

2. A method according to claim 1 wherein the color-formers used comprise at least 90% of colour-formers which incorporate lactone rings or fluoran groups and are monoamino and/or diamino fluoran derivatives, and/or phthalide derivatives and/or pyridyl derivatives.

3. A method according to claim 1 wherein the colour-formers used comprise at least 90% of colour-formers which are monoamino and/or diamino fluoran derivatives.

4. A method according to claim 1 wherein the colour-former solution comprises 100% monoamino and/or diamino fluoran derivatives.

5. A method according to claim 1 wherein said colour-formers are dissolved in said oils at a temperature in the range 100° C. to 135° C.

6. A method according to claim 1 wherein the colour-former solution droplets are confined in a continuous phase of said rupturable material.

7. A method according to claim 1 wherein the colour-former solution droplets are confined in individual micro-capsules made from said rupturable material.

8. A method according to claim 7 wherein said micro-capsules are formed from a gelatine-based material.

* * * * *